US005709572A

United States Patent [19]

Hotea et al.

[11] Patent Number: 5,709,572

[45] Date of Patent: Jan. 20, 1998

[54] ELECTRICAL DISTRIBUTION BOX AND A METHOD OF MAKING

[75] Inventors: Gheorghe Hotea, Griesheim; Martin Listing, Dreieich; Marianne Eva Modler, Erzhausen, all of Germany

[73] Assignee: The Whitaker Corporation, Wilmington, Del.

[21] Appl. No.: 578,114

[22] Filed: Dec. 26, 1995

[30] Foreign Application Priority Data

Jan. 24, 1995 [GB] United Kingdom ..... 9501350

[51] Int. Cl.[6] ..... H01R 11/09

[52] U.S. Cl. ..... 439/723; 439/76.2

[58] Field of Search ..... 439/76.2, 113–114, 439/723, 724

[56] References Cited

U.S. PATENT DOCUMENTS 5,023,742 6/1991 Detter et al. ..... 361/399
5,052,951 10/1991 Johnson ..... 439/724 X
5,192,233 3/1993 Suffredini et al. ..... 439/723
5,199,906 4/1993 Wang ..... 439/723
5,207,587 5/1993 Hamill et al. ..... 439/76
5,295,842 3/1994 Ozaki et al. ..... 439/883 X
5,295,847 3/1994 Ozaki et al. ..... 439/724 X

FOREIGN PATENT DOCUMENTS 0 520 284 A2 12/1992 European Pat. Off. .
0 572 052 A1 12/1993 European Pat. Off. .

*Primary Examiner*—Khiem Nguyen
*Attorney, Agent, or Firm*—Driscoll Nina

[57] ABSTRACT

An electrical distribution box comprising a box having a first outer portion and a second outer portion that include multiple stamped and formed circuit grids therein characterized in that at least one of the stamped and formed circuit grids are positioned and retained in the first portion and at least one of the stamped and formed circuit grids are retained in the second portion.

7 Claims, 6 Drawing Sheets

. 8

ELECTRICAL DISTRIBUTION BOX AND A METHOD OF MAKING

BACKGROUND OF THE INVENTION

1. Field of the Invention

This invention relates to an electrical distribution box, a method of making said boxes and a contact receptacle for use therewith, particularly to receptacles that are included as part of a terminal for mating with a tab or pin type terminal.

2. Description of the Prior Art

In the prior art, there are numerous examples of electrical contact receptacles designed to mate with a tab terminal. Typically, these receptacles comprise at least one pair of oppositely disposed spring arms having contact surfaces thereupon which are adapted to come into contact with opposing sides of the tab terminal. As a tab terminal has a width that is much greater than its thickness these prior art contact receptacles limit the orientation of the tab terminal to two positions, 180° apart. There are numerous applications where it would be desirable to have a contact receptacle capable of receiving a tab terminal in a plurality of orientations, such that the tab terminal would be electrically engaged within the contact receptacle when received therein.

One particular example, is with respect to an electrical power distribution center that provides electrical interconnections between electrical and electronic devices and electrical wiring connections in a vehicular electrical system. One example of this type of electrical distribution center is presented in U.S. Pat. No. 5,023,752. In this patent a pre-stamped metal circuit component includes tab terminals bent transversely thereto for interconnection with the tab terminal of electrical and electronic device, such as fuses and relays. In order to interconnect these tab terminals a double-ended female terminal is located therebetween. The particular double-ended female terminal disclosed requires the tab terminal of the circuit grid to be similarly orientated with the tab terminal from the component. This limitation controls where on the circuit grid the tab terminal must be folded from. In many instances, it may be more desirable to fold the tab terminal from a different location which would result in the tab being oriented differently than the tab terminal of the device.

An additional problem in prior art distribution boxes is the need to laminate the stamped and formed circuit grids between multiple layers of insulative plates. This makes for a difficult assembly procedure incorporating multiple components which must be sequentially stacked together. The result being a box having a large number of components.

In order to solve these problems, it would be desirable to have an electrical distribution box that could be simply assembled whereby the number of components are reduced. Furthermore, it would be desirable to have a contact receptacle capable of receiving the tab terminal of the device in a plurality of orientations, thereby eliminating the necessity of similarly aligning the tabs to be interconnected.

SUMMARY OF THE INVENTION

It is an object of this invention to provide a method of assembling electrical distribution boxes wherein the number of components are reduced and the assembly is simplified.

It is an aspect of one embodiment of this invention to provide an terminal adaptor for interconnecting tab-type terminals where at least one of the tabs may be received in the contact receptacle in a plurality of orientations.

The object of providing a simplified electrical distribution box and method of making is accomplished by having a box comprising a first and second box portions wherein a stamped and formed circuit grid is disposed in each of the portions and retained therein such that when the portions are assembled the circuits grids are properly oriented and separated by the structure of the box portions.

It is an advantage of the distribution box that the complexity of the components, their assembly, and their interaction is greatly reduced. It is another advantage of the distribution box that the layers incorporated into each box half are reduced making them more accessible. It is yet another advantage that when adaptors capable of receiving tabs in a plurality of orientations are used in conjunction with a stamped and formed circuit grid having tabs formed therefrom, the tabs may be formed to make optimum use of the material regardless of the orientation of the mating tab.

DETAILED DESCRIPTION OF THE PREFERRED EMBODIMENT

Figure 1:
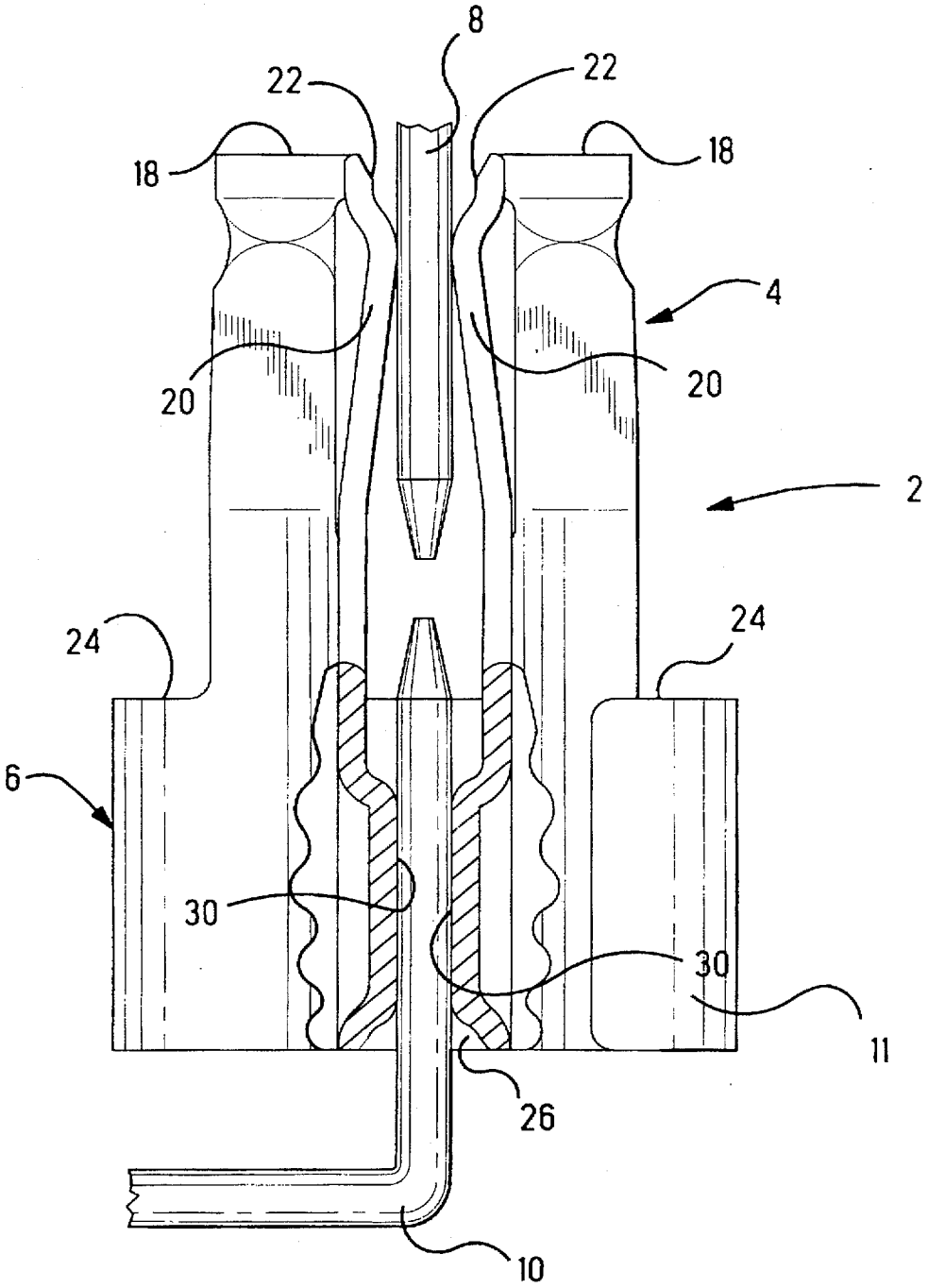
FIG. 1 is a partially broken away side view of an electrical terminal for interconnecting tab terminals.

With reference first to FIG. 1, an electrical terminal that functions as an adapter in a distribution box is shown at 2. The electrical terminal 2 comprises a contact receptacle 4 at one end and a conductor mating end 6 at the other end. The contact receptacle 4 is constructed to receive a tab terminal 8 in a plurality of orientations, as will be described below. The conductor mating end 6, in this embodiment, is constructed to receive a second tab terminal 10, thereby forming a terminal that functions as an adapter for interconnecting opposing male terminals 8,10. In FIG. 1, the tab terminals 8,10 are shown in a similar orientation. It should be noted that the conductor mating end 6 may be configured in any number of ways. For example, an insulation displacement contact may be included for engaging an insulated conductor, a surface mountable foot or pin may be included for mating with a circuit trace of a printed circuit board, or the contact mating end 6 may be adapted to mate with other electrical connectors.

Figure 2:
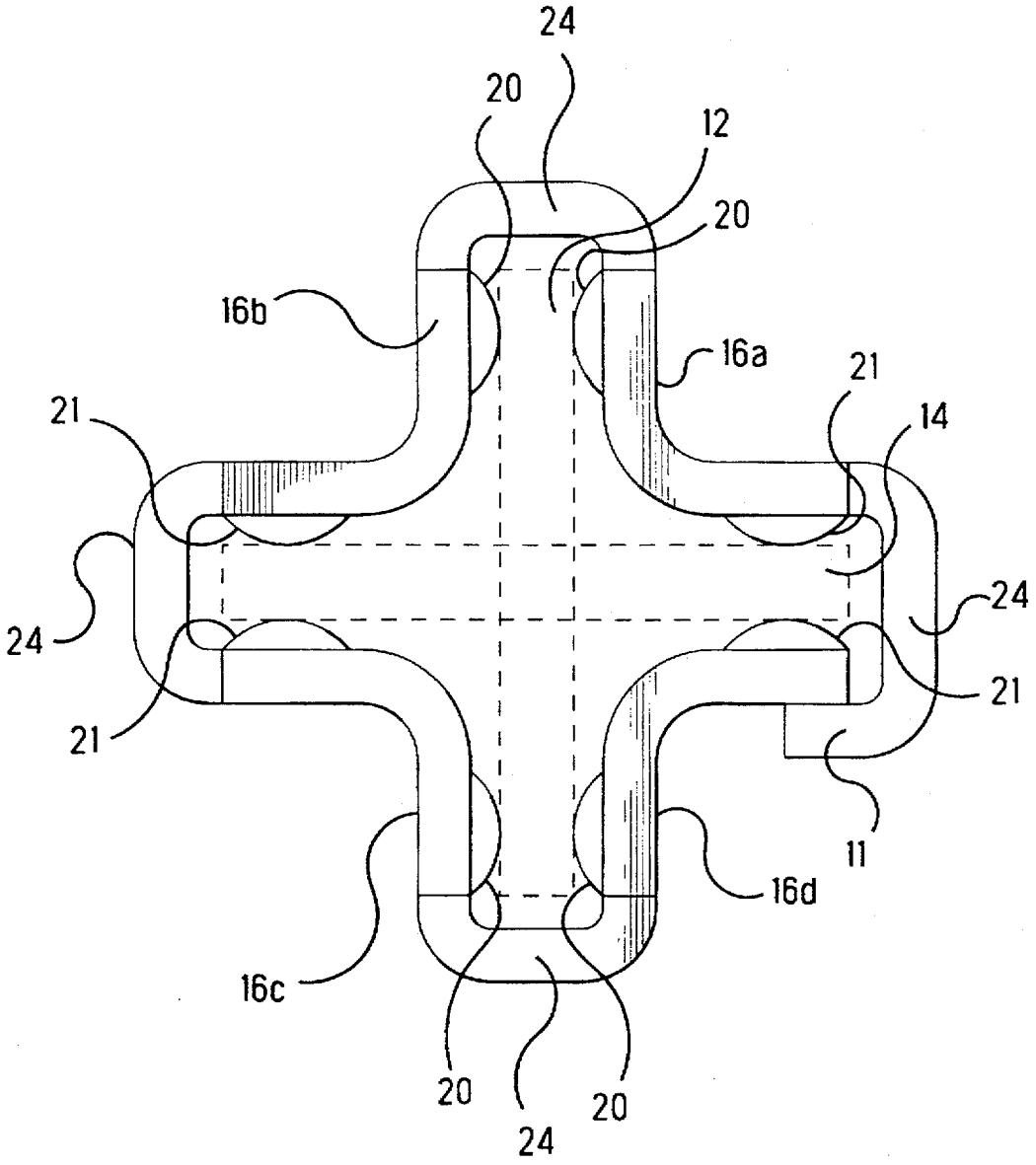
FIG. 2 is a top view of the contact receptacle of the electrical terminal of FIG. 1.

With reference now to FIG. 2, the electrical terminal 2 is folded into a cross-shaped tubular member from one piece of conductive material having the desired electrical and mechanical characteristics. A tab 11 is folded over to retain the integrity of the shape. This tab 11 may be affixed where it overlaps, if necessary, by such processes as laser welding. The contact receptacle 4 defines a first terminal receiving region 12 and a second terminal receiving region 14 oriented perpendicular to each other and centrally intersecting. These terminal receiving regions 12,14 are defined by four upstanding spring members 16*a*, 16*b*, 16*c* and 16*d* each of which extend to a free end 18 opposite from the conductor mating end 6. Each of these spring arms 16*a–d* contain an inwardly directed terminal engaging portion 20 that corresponds to the first terminal receiving region 12 and a second inwardly directed terminal engaging portion 21 that corresponds to the second terminal receiving region 14. These portions 20,21 are constructed to make an interference fit with the terminal that is inserted therein to make electrical contact. The arms 16*a–b* also include an outwardly directed portion 22 at the free end 18 and corresponding to each engaging portion 20,21 form a guide for the insertion of terminal 8 into the respective terminal engaging region 12, 14 of the contact receptacle 4.

The spring arms 16*a–d*, are L-shaped members at the inner portion of the tubular cross shaped terminal 2 that face outward from the center of the tube which includes the terminal receiving regions 12,14 of the electrical terminal 2. The spring arms 16*a–d* are formed by removing a portion of the material that corresponds to the outer lobes 24 of the cross-shaped tubular terminal 2, thereby providing the independent resilience. If desired, it would be also possible to interconnect the spring arms 16*a–d* at free end 18 by a strap which is integrally formed with the terminal or is separate therefrom.

Figure 3:
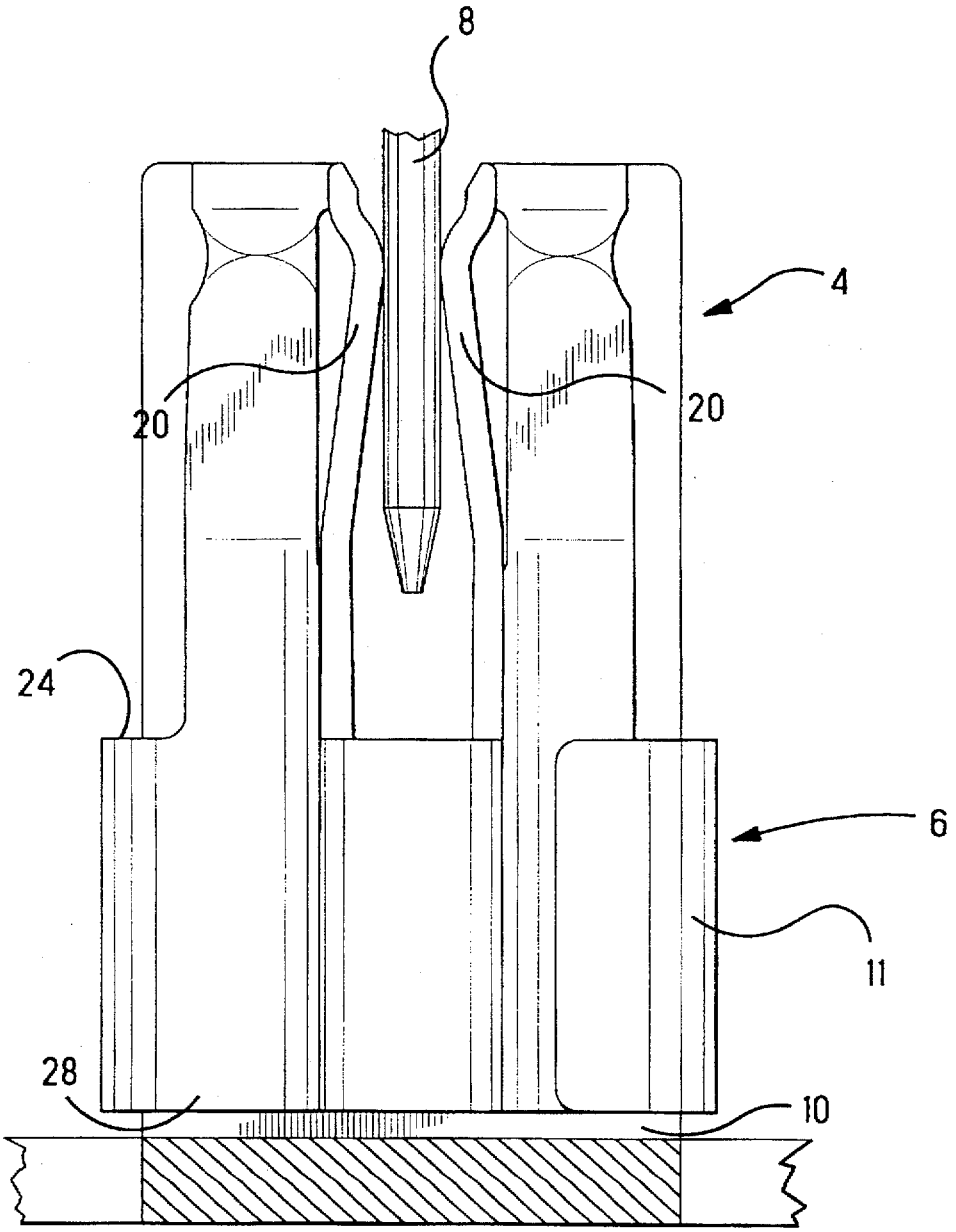
FIG. 3 is a side view of the electrical terminal of FIG. 1 showing mating tab terminals oriented 90° to each other.

The conductor mating end 6, in this embodiment is similarly configured to the contact receptacle 4 in that it includes a pair of conductor receiving regions 26,28 that correspond to the terminal receiving regions 12,14 of the contact receptacle 4. This construction enables the second terminal 10 to also be selectively received in the various regions 26,28. This is best observed by comparing FIGS. 1 and 3. With reference to FIG. 1, the conductor receiving regions 26,28 of the conductor mating end are formed by forming inwardly disposed surfaces 30 along the tubular walls corresponding to extensions of spring arms 16*a–d*, such that a conductor 10 will be received therein in an interference fit.

Figure 4:
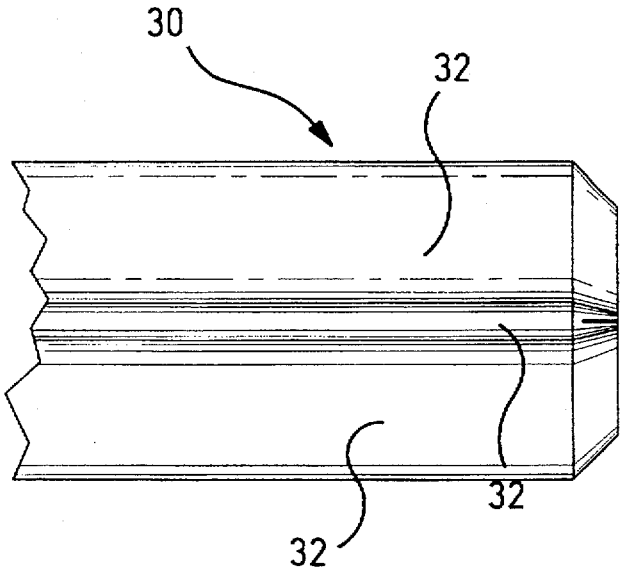
FIG. 4 is a side view of a portion of a terminal configured to be received within the terminal receiving regions of the contact receptacle of FIG. 1.
Figure 5:
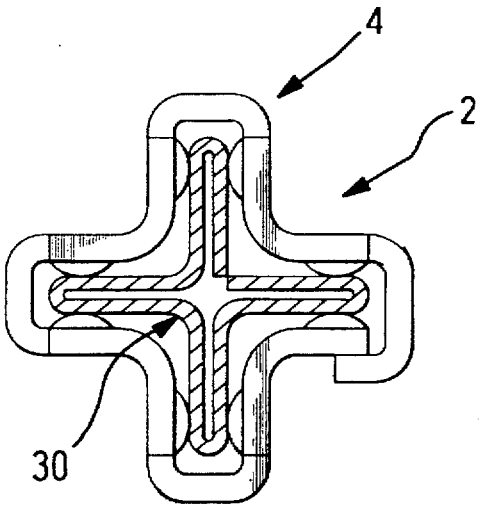
FIG. 5 is an end view of the terminal of FIG. 4.
Figure 6:
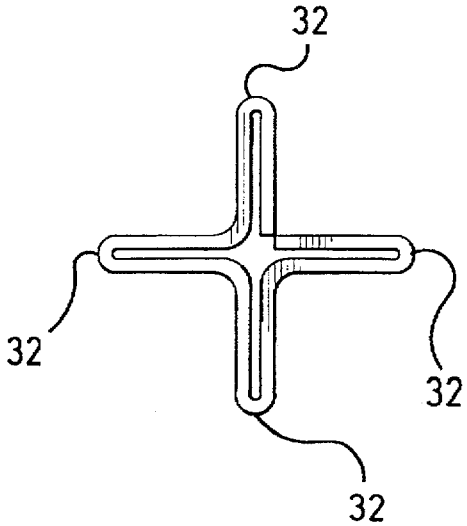
FIG. 6 is a top view of the contact receptacle of FIG. 1 showing a cut away portion of the terminal of FIG. 4 received therein.

With reference now to FIG. 4 and FIG. 5, a mating portion 30 of an electrical terminal (not shown) is constructed to be received within both terminal receiving regions 12,14 simultaneously. The terminal 30 has a cross-shape cross-section having four outstanding ears 32 that are configured to be received within the terminal receiving regions 12,14 of the tubular terminal 2. As each of the four spring arms 16*a–d* include two inwardly directed surfaces 20,21 that are orthogonally opposed to each other, the cross-shaped terminal 30 will be engaged in 8 places, as shown in FIG. 6. The 8 point engagement assures reliable interconnection and the transfer of current.

Figure 7:
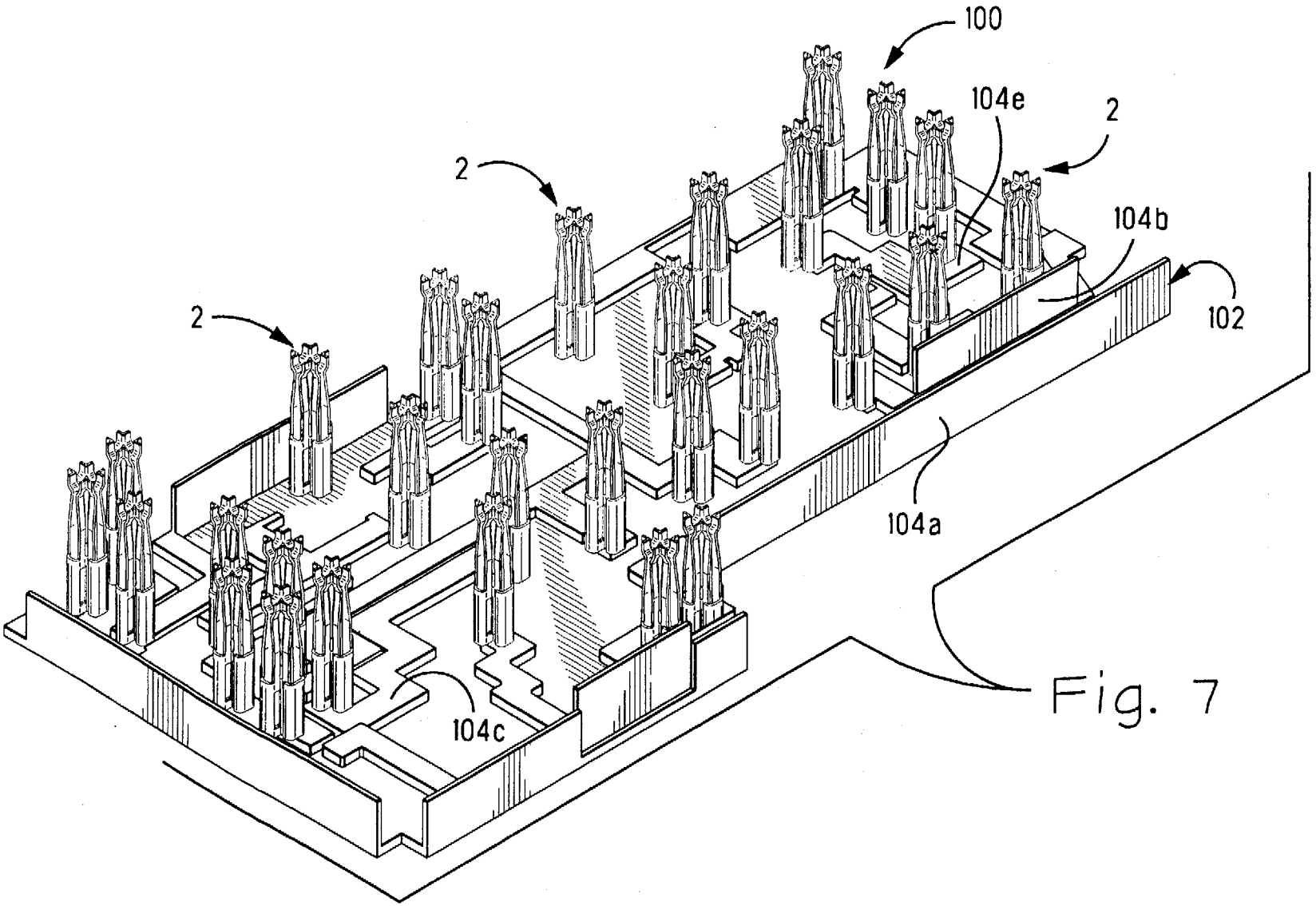
FIG. 7 is a perspective view of a circuit grid incorporating the contact receptacle of claim 1; and, FIG. 8 is a partially cut away perspective view of an electrical distribution box incorporating the circuit grid of FIG. 7.

With reference now to FIG. 7, a circuit grid assembly incorporating the receptacle terminal 2 is shown at 100. The circuit grid assembly 100 includes a circuit grid 102 having a plurality of circuit links 104*a–e* that have a plurality of tabs folded upward therefrom, whereupon the receptacles 2 are mounted. Some of the links 104*a* may include a portion folded transverse to the general place of the grid in order to conserve space, especially at the outer boundary thereof. The multiple contact receiving areas of the terminal as described above enable the tabs to be bent up where it is most desirable, such as with respect to material conservation. Furthermore the multiple tab receiving cavities at the bottom of the receptacle 2 which would receive the tab of the circuit grid 102 enable easy assembly of the receptacles as multiple positions are possible. The circuit grids 102 may be stamped and formed from a continuous sheet of material, as with a lead frame, and wound upon a continuous coil, with webs interconnecting the respective circuit links 104*a–e*, prior to bending the tabs outward therefrom.

Figure 8:
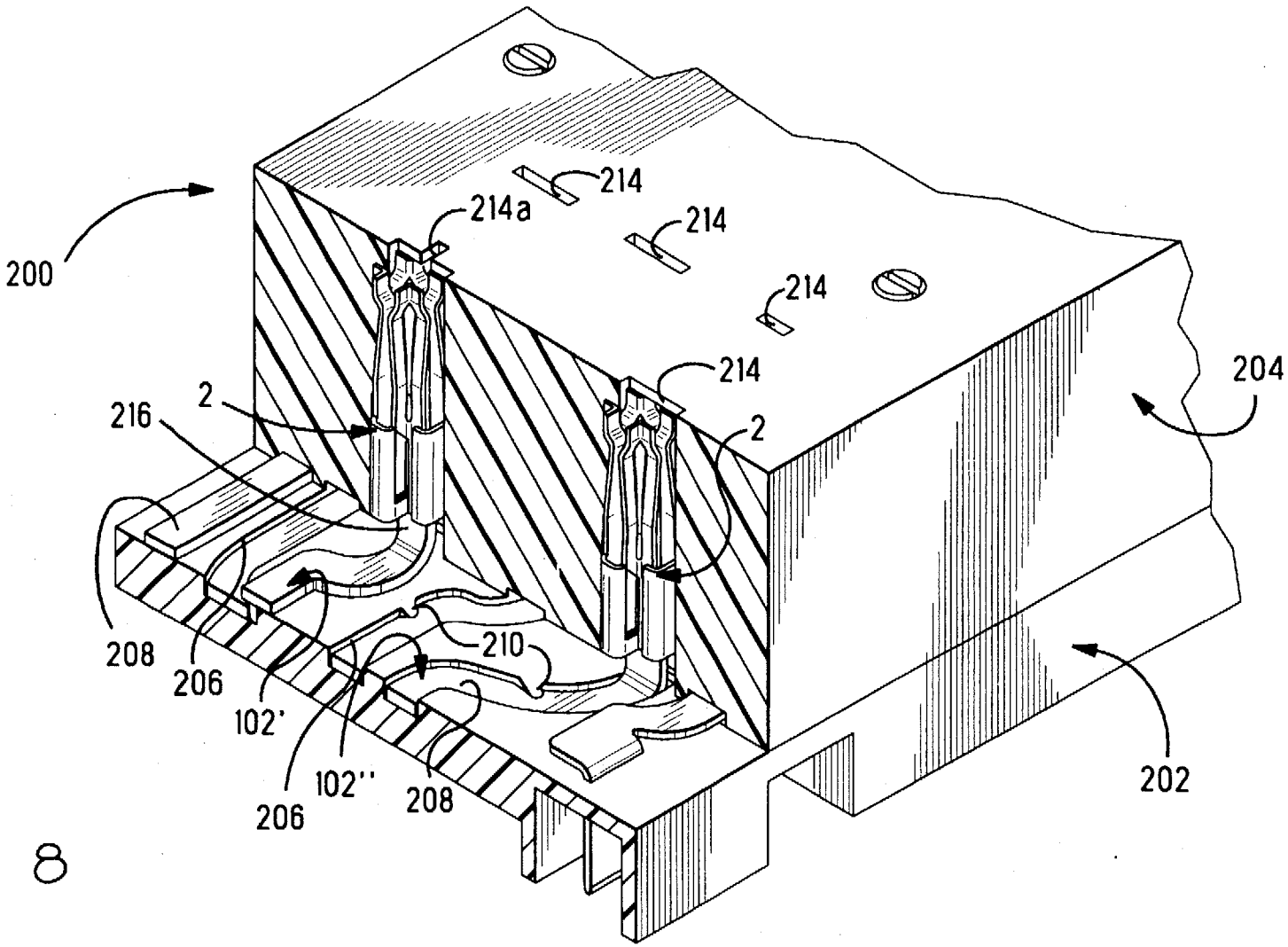

With reference now to FIG. 8, an electrical distribution box incorporating a circuit grid assembly similar to that of FIG. 7 is shown generally at 200. The electrical distribution box 200 includes a first outer portion 202 and a second outer portion 204. A circuit grid 102', similar to that shown in FIG. 7, is mounted in the second portion 204 of the box 200; while a second circuit grid 102" is mounted in the first portion 202 of the box 200.

The first and second portions 202,204 each include passageways 206 therein where circuit links 208 of the circuit grids 102',102" are received. The circuit links are positively retained in the passageways 206 by such processes as heat staking, shown for example at 210 where the side 212 of the passageways 206 are melted to overlie the circuit link 208. In addition, one of the mating portions 202,204 may include posts that would sit on, or be closely disposed to, the corresponding circuit link 208 located in a passageway 206 of the mating portion 204,202 so that the link 206 is captured therein and may not be displaced therefrom.

The second mating portion 204 includes a plurality of tab receiving openings 214 for receiving a tab of a mating component (not shown), such as a fuse or relay. As can be seen with reference to opening 214*a* the mating tab will be received 90 degrees to a tab 216 of the circuit grid 102'. The receptacle 2 provides the flexibility necessary to enable the tab 216 to be bent from where material exists and not be limited by the needed end orientation.

The distribution box 200 is assembled by first forming the first and second housing portions 202,204 and the desired circuit grids. The circuit grids 102',102" could be stored upon the coils as described above. The circuit grids 102', 102" are then presented at the respective first or second portions 202,204 and placed therein. The tabs could have been bent outward from the grid 102',102" prior to placing the circuit links 208 of the grid within their respective passageways 206 of the proper portion. The links 208 may then be retained in the passageways 206 by such process as heat staking. If the circuit grids 102' 102" were inserted with the circuit links interconnected by webs, the webs can be sheared thereby separating the links. If desired, the receptacle terminals may then be set upon the tabs. Finally, with the circuit grids 102',102" now positioned and retained in their respective portions 202,204, the portions may be mated together in sandwich manner, whereby the electrical distribution box is formed.

Advantageously, then an electrical distribution box is produced that incorporates multiple circuit grids in a simple and easy to assemble manner as positioning of the grids is dependent upon aligning of the housings rather than having to position a subassembly of grids and insulation plates within a housing.

We claim:

1. An electrical distribution box comprising a box having a first outer portion and a second utter portion joined together and included therein are multiple stamped and formed circuit grids characterized in that at least one of the stamped and formed circuit grids are positively positioned and retained in the first outer portion separate from the second outer portion and at least one of the stamped and formed circuit grids are positively retained in the second outer portion separate from the first outer portion.

2. The electrical distribution box of claim 1 wherein one of the circuit grids include receptacle contacts configured to accept a mating tab in more than one orientation.

3. The electrical distribution box of claim 1 wherein one of the circuit grids includes tabs extending in opposite directions relative the grid for interconnection on opposite sides of the box.

4. The electrical distribution box of claim 1 wherein one of the first and second outer portions include channels wherein links of the circuit grids are disposed.

5. The electrical distribution box of claim 4, wherein the links are retained in the channels of the corresponding outer portion by deforming a portion of outer portion into interference with the link.

6. The electrical distribution box of claim 1 wherein the outer portions form the electrical distribution box.

7. The electrical distribution box of claim 1 wherein at least one of the multiple stamped and formed circuit grids are made up of links and at least one link is retained in the corresponding outer portion by deforming the outer portion about the link by heat staking.

* * * * *